US012583666B2

(12) United States Patent
Edvinsson et al.

(10) Patent No.: US 12,583,666 B2
(45) Date of Patent: Mar. 24, 2026

(54) CLIMATE-CONTROLLED FREIGHT CONTAINER AND A METHOD FOR CONTROLLING THE CLIMATE IN A CLIMATE-CONTROLLED FREIGHT CONTAINER

(71) Applicant: ENVIROTAINER ENGINEERING AB, Sollentuna (SE)

(72) Inventors: Lars Edvinsson, Uppsala (SE); David Egertz, Enskededalen (SE); Peter Montin, Åkersberga (SE)

(73) Assignee: ENVIROTAINER ENGINEERING AB, Sollentuna (SE)

( * ) Notice: Subject to any disclaimer, the term of this patent is extended or adjusted under 35 U.S.C. 154(b) by 440 days.

(21) Appl. No.: 18/029,482

(22) PCT Filed: Sep. 29, 2021

(86) PCT No.: PCT/SE2021/050955
§ 371 (c)(1),
(2) Date: Mar. 30, 2023

(87) PCT Pub. No.: WO2022/071858
PCT Pub. Date: Apr. 7, 2022

(65) Prior Publication Data

US 2023/0365327 A1 Nov. 16, 2023

(30) Foreign Application Priority Data

Oct. 2, 2020 (SE) ..... 2051163-0

(51) Int. Cl.
*B65D 88/74* (2006.01)
*B65D 81/38* (2006.01)

(52) U.S. Cl.
CPC ..... *B65D 88/745* (2013.01); *B65D 81/38* (2013.01)

(58) Field of Classification Search
CPC ..... B65D 88/745; B65D 81/38
(Continued)

(56) References Cited

U.S. PATENT DOCUMENTS 4,879,877 A 11/1989 Hicke
6,012,384 A 1/2000 Badalament et al.
(Continued)

FOREIGN PATENT DOCUMENTS

WO WO-91/07630 5/1991
WO WO-2010/147797 A3 12/2010
(Continued)

OTHER PUBLICATIONS

International Search Report for Application No. PCT/SE2021/050955 dated Nov. 11, 2022.
(Continued)

*Primary Examiner* — Md Azad
(74) *Attorney, Agent, or Firm* — MOSER TABOADA

(57) ABSTRACT

A climate-controlled freight container (10) comprises a casing (12), enclosing a cargo compartment (20) and a control compartment (26). The container further comprises a climate system (30) that has at least two climate modules (40) and an air distribution arrangement (21), configured to distribute air from the climate system into the cargo compartment and. A central climate-control unit (52) is configured for collection of measurements associated with climate conditions of the cargo compartment and for controlling the climate system. Each of the climate modules is configured for adapting climate properties of air flowing through the climate modules from a return air plenum (36) to a supply air plenum (34). Each of the at least two climate modules comprises a local climate-control unit (46), configured for controlling an operation of the climate module. The central
(Continued)

climate-control unit is configured for providing operational instructions to the local climate-control units.

20 Claims, 5 Drawing Sheets

(58) Field of Classification Search
USPC ..... 700/300
See application file for complete search history.

(56) References Cited

U.S. PATENT DOCUMENTS

| | | | | |
|---|---|---|---|---|
| 2003/0101742 | A1 | 6/2003 | Norelius et al. | |
| 2004/0226309 | A1 | 11/2004 | Broussard | |
| 2009/0212047 | A1 | 8/2009 | Harman et al. | |
| 2009/0248218 | A1* | 10/2009 | Dyrmose | F25D 29/003 700/300 |
| 2010/0101262 | A1 | 4/2010 | Uluc et al. | |
| 2010/0191615 | A1* | 7/2010 | Thomas | B65D 90/008 52/27 |
| 2016/0216028 | A1* | 7/2016 | Jónsson | F25D 11/003 |
| 2018/0274843 | A1 | 9/2018 | Lombardo et al. | |
| 2018/0347895 | A1* | 12/2018 | Jonsson | G06Q 10/0832 |
| 2020/0247606 | A1* | 8/2020 | Chen | F25D 17/06 |
| 2021/0116156 | A1* | 4/2021 | Waters | F25B 41/22 |
| 2022/0026139 | A1* | 1/2022 | LaValley | F25D 11/003 |
| 2022/0080803 | A1* | 3/2022 | Lavrich | G07C 5/0825 |
| 2022/0090924 | A1* | 3/2022 | Schumacher | B60H 1/00428 |

FOREIGN PATENT DOCUMENTS

| | | | |
|---|---|---|---|
| WO | WO-2011/035102 | A1 | 3/2011 |
| WO | WO-2017/083336 | A1 | 5/2017 |

OTHER PUBLICATIONS

Swedish Search Report for Application No. 2051163-0 dated May 11, 2021.

Extended European Search Report for Application No. 21876090.8 dated Sep. 17, 2024, 7 pages.

* cited by examiner

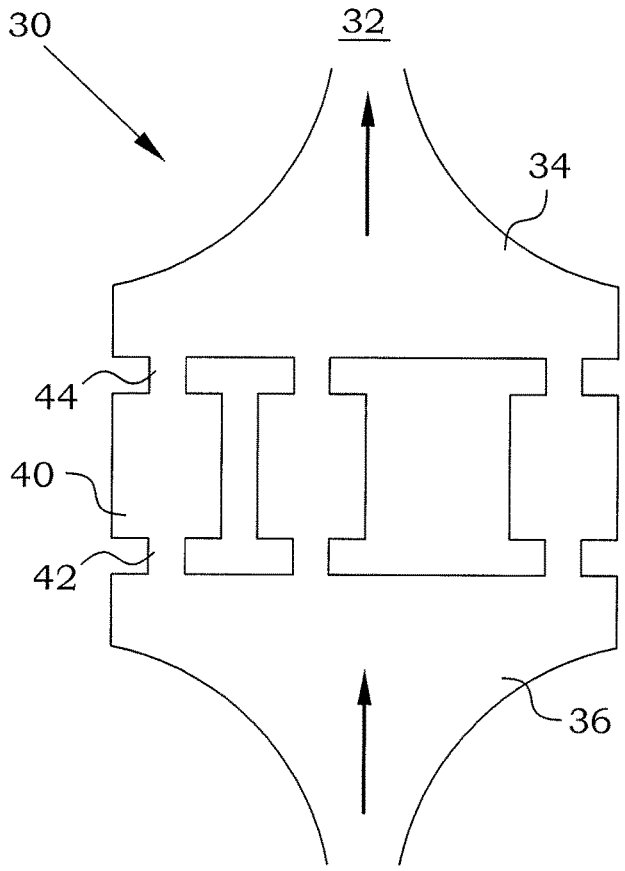
Fig. 1
Fig. 2
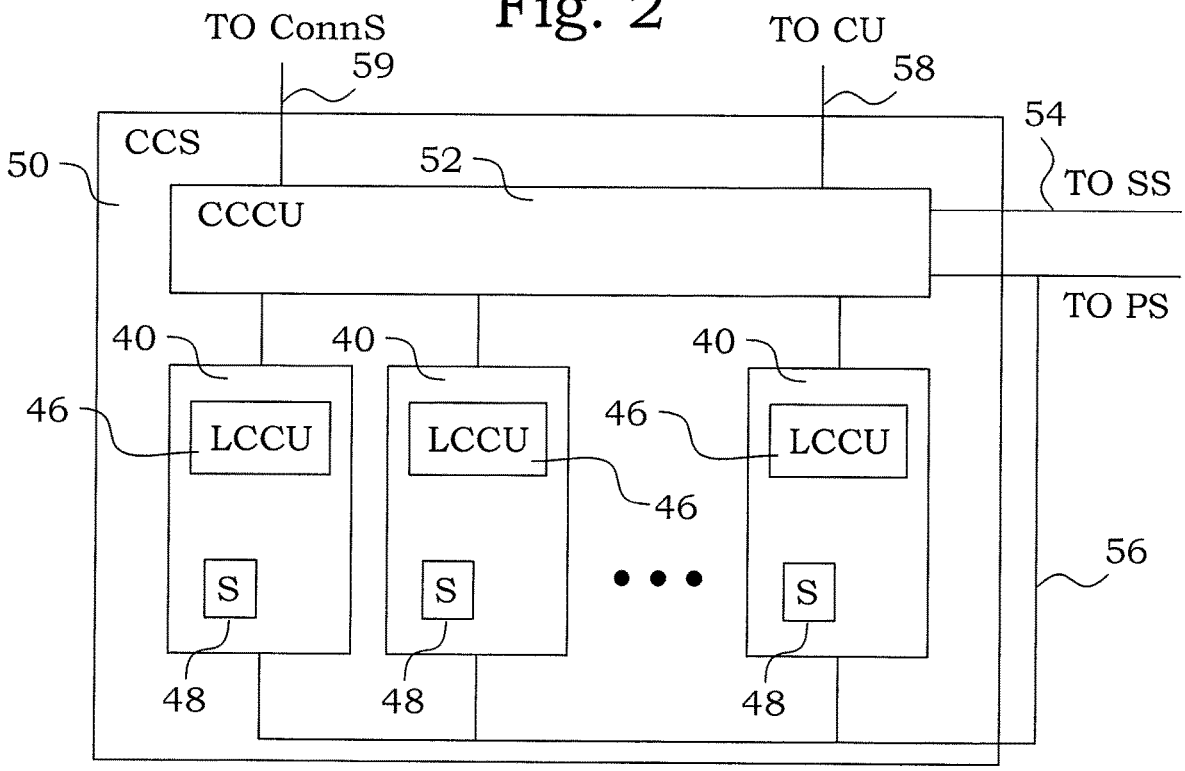

CLIMATE-CONTROLLED FREIGHT CONTAINER AND A METHOD FOR CONTROLLING THE CLIMATE IN A CLIMATE-CONTROLLED FREIGHT CONTAINER

TECHNICAL FIELD

The present invention relates in general to climate-controlled freight containers and in particular to methods and devices for modular operation of a climate-controlled freight container.

BACKGROUND

Today, transportation of goods worldwide is a huge business, having impact on the daily life of substantially all people around the world. Many products are produced far from the location where they are assumed to be consumed or used, and transportation is therefore crucial. Many products today are sensitive for storage/transportation times, the environment, and physical exposure of e.g. vibrations or shocks. For shortening the transportation time, air-freight is often used.

Transporting sensitive goods by air-freight is a huge challenge. Climate-controlled air-freight containers are available since many years. The common basic idea is to produce a climate-controlled flow of air, or other gas, that is entered into the cargo compartment. The cooling action may furthermore be controlled based on different sensor measurements, usually of the temperatures within the systems. For long time, the refrigeration was relying on passive cooling by dry ice, but in recent years, battery-powered refrigeration equipment has become widely used for active cooling.

Different goods have different demands on climate control. Typically, an allowed temperature range is defined for each transport. Some types of goods require very stable temperature conditions, which means that the allowed temperature range must be set very narrow. Other types of goods require low temperatures during the entire transport chain, which means that the allowed temperature range is defined for low temperatures. Moreover, different transports are scheduled according to different routes, having different probabilities for encountering high or low ambient temperatures. The different transports are also scheduled to have different expected total transport time during which autonomous climate control operation must be maintained and different levels of risks for delays. To provide an efficient climate control operation, the hardware and software for achieving this may vary considerably. One solution to this is to develop different models of air-freight containers, each one specialized on different conditions in terms of autonomy time, expected thermal load, control accuracy demands etc. However, this will inevitably lead to a large number of unused containers at each time instant.

SUMMARY

A general object of the present invention is to provide methods and devices for climate-controlled freight containers that allows a flexible use of the containers.

The above object is achieved by methods and devices according to the independent claims. Preferred embodiments are defined in dependent claims.

In general words, in a first aspect, a climate-controlled freight container comprises a casing, enclosing a cargo compartment and a control compartment. The control compartment has a climate module support with at least two mounting positions. The climate-controlled freight container further comprises a general control unit, configured for surveillance of container conditions. The climate-controlled freight container further comprises a climate system that has at least two climate modules mounted in the climate module support and an air distribution arrangement. The air distribution arrangement is configured to distribute air from a supply air plenum of the climate system around and/or into the cargo compartment, and back to a return air plenum of the climate system. The climate-controlled freight container further comprises a central climate-control unit. The central climate-control unit is configured for collection of measurements associated with climate conditions of the cargo compartment. The central climate-control unit is also configured for controlling the climate system to maintain predetermined climate conditions in the cargo compartment. The climate-controlled freight container further comprises a power system, powering the climate system and the control units. The climate-controlled freight container further comprises a central power-control unit, for monitoring and controlling power distribution from the power system. Each of the at least two climate modules is configured for adapting climate properties of air flowing through the respective one of the at least two climate modules from the return air plenum to the supply air plenum. Each of the at least two climate modules comprises a local climate-control unit. The local climate-control unit is configured for controlling an operation of the respective one of the at least two climate modules. The local climate-control unit is communicationally connected to the central climate-control unit. The central climate-control unit is configured for providing operational instructions to the local climate-control units.

In a second aspect, a climate-control method for a freight container comprises collecting of measurements associated with climate conditions of a cargo compartment of the freight container. Air is distributed from a supply air plenum of a climate system around and/or into the cargo compartment, and back to a return air plenum of the climate system. The climate system has at least two climate modules. The climate system is controlled to maintain predetermined climate conditions in the cargo compartment. The controlling of the climate system in turn comprises providing of operational instructions from a central climate-control unit of the climate system to local climate-control units of the at least two climate modules. The controlling of the climate system further comprises adapting of climate properties of air flowing through the respective one of the at least two climate modules from the return air plenum to the supply air plenum. A local control of an operation of the respective one of the at least two climate modules is performed in each of the at least two climate modules based on the operational instructions to the local climate-control units.

One advantage with the proposed technology is that it provides both flexibility and redundancy to the climate-control of the freight container. Other advantages will be appreciated when reading the detailed description.

BRIEF DESCRIPTION OF THE DRAWINGS

The invention, together with further objects and advantages thereof, may best be understood by making reference to the following description taken together with the accompanying drawings, in which:

FIG. 1 is a schematic drawing of an embodiment of fluid connections of climate modules;

FIG. 2 is a schematic drawing of an embodiment of logical and electrical connections of climate modules;

DETAILED DESCRIPTION

Figure 3:
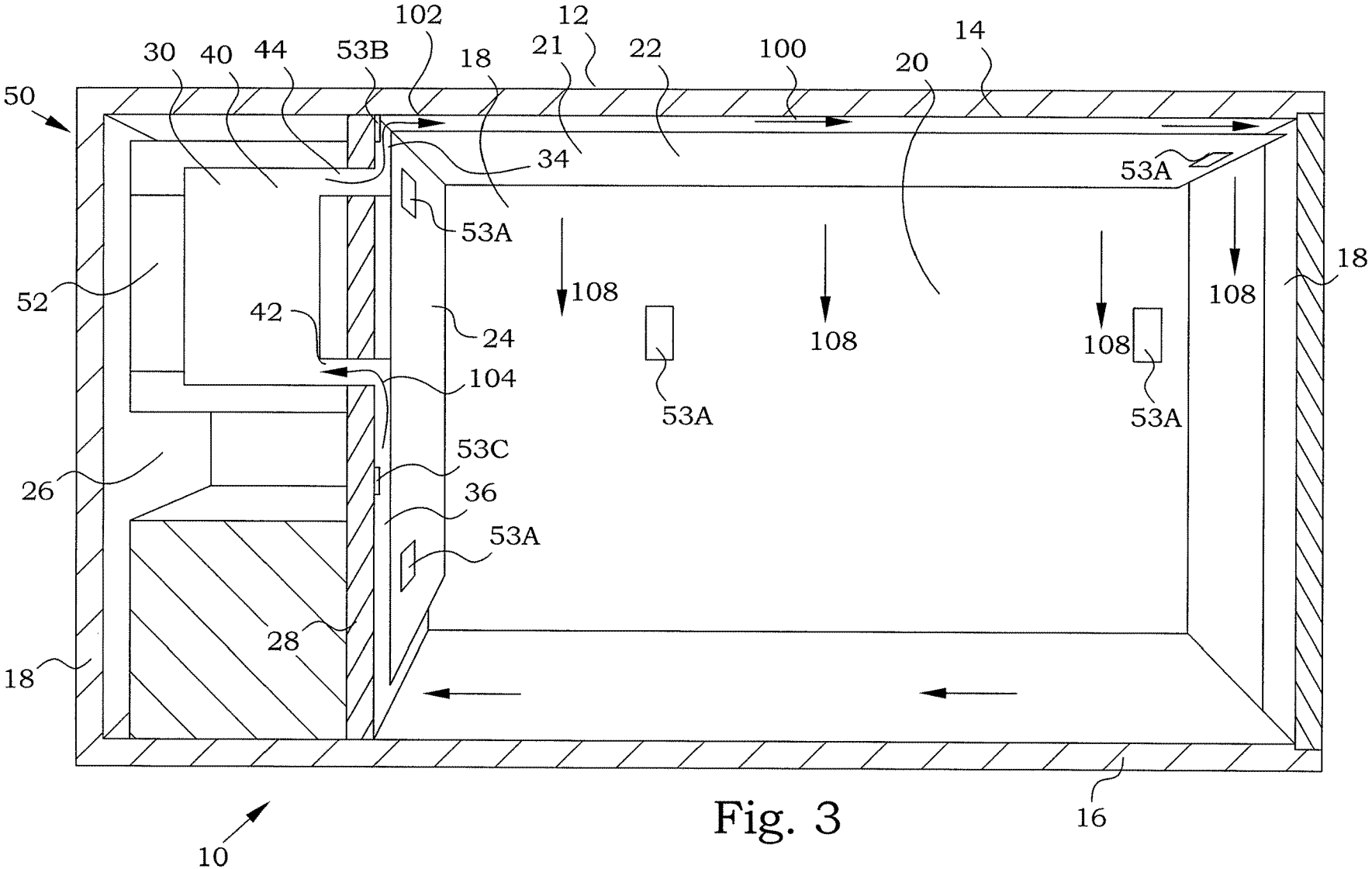
FIG. 3 is a cross-sectional view of an embodiment of a climate-controlled air-freight container.

Throughout the drawings, the same reference numbers are used for similar or corresponding elements.

In the following, embodiments of air-freight containers are described. However, even though the present ideas are of most benefit for air freight, the same approaches are also operational for other types of freight containers. Thus, in one preferred embodiment, the freight container is an air-freight container.

For a better understanding of the proposed technology, it may be useful to begin with a brief overview of efforts to achieve flexibility. One often used approach to achieve flexibility is to divide crucial operations into modules. This opens the possibility to select not only the number of modules to use, but also to select modules of particular properties. However, in practice, the module handling becomes more complex than just a simple exchange of modules, since the modules have to operate with the entire system as well as with the other modules. When combining a number of modules, the normal procedure is to adapt a central control system to take care of the operation control of the modules as well as the cooperation therebetween. This means that every change in module configuration has to be followed by a corresponding adaption of the control system. This may be both complex and time consuming. However, if the control system is configured in a particular way, as described below, such disadvantages may be prevented.

In a climate-controlled air-freight container, one of the most prominent operations that has to be provided is the climate control. The most used climate-control approach is to provide a stream of climate-controlled air or other gas to be flooded into and/or around the cargo compartment of the container. Following the module approach, a number, at least two, of climate modules are provided. In order to provide maximum flexibility, any selection or combination of the climate modules should preferably be possible to operate simultaneously. This calls for the physical connection of the climate modules to be designed so that they will operate on a same air-flow from and to the cargo compartment of the container. A climate system 30 of the container has therefore an air distribution arrangement 32 that is configured to distribute air from a supply air plenum 34 of the climate system around and/or into the cargo compartment, and back to a return air plenum 36 of the climate system 30. The climate modules of the climate system are thus fluidly connected to the supply air plenum and to the return air plenum. This is schematically illustrated in FIG. 1. An input port 42 of each of the climate modules 40 is individually connected to the return air plenum 36. When the climate module 40 is in operation, air will be taken from the return air plenum 36 in order to be climate controlled. An output port 44 of each of the climate modules 40 is likewise individually connected to the supply air plenum 34, to provide the climate-controlled air during operation. These conditions are achievable by preparing a control compartment of the container to have a climate module support with a number of prearranged mounting positions, corresponding to a maximum number of intended climate modules. When less than the maximum number of climate modules are used, the unused input and output openings of the supply air plenum and the return air plenum are simply plugged.

This mechanical arrangement has to be combined with a two-level control system in order to provide true flexibility as well as redundancy. An embodiment of such a climate-control system 50 is illustrated in FIG. 2. A central climate-control unit 52 is provided for collection of measurements associated with climate conditions of the cargo compartment. The central climate-control unit 52 is also configured for controlling the climate system to maintain predetermined climate conditions in the cargo compartment. The central climate-control unit 52 is communicationally connected 54 to a surveillance system, which comprises sensors for measuring the requested climate conditions of the cargo compartment. Typically, at least some of these sensors are temperature sensors provided in the cargo compartment or in the air flow to or from the cargo compartment. The central climate-control unit 52 processes the collected measurements and decides if and what actions to be taken. The central climate-control unit 52 is thus connected to the sensors of the container, which sensors provide the necessary feed-back information of the climate-control of the cargo compartment.

The climate-control system 50 comprises at least two climate modules 40, in the present embodiment three climate modules 40. Each of the climate modules 40 comprises a local climate-control unit 46. The local climate-control unit 46 is configured for controlling an operation of the associated climate module 40. The local climate-control unit 46 is connected to the central climate-control unit 52. The central climate-control unit 52 is configured for providing operational instructions to the local climate-control units 46. In this way, the central climate-control unit 52 is made responsible for the collection of measurements on which the climate-controlling is to depend. Thereby, the central climate-control unit 52 becomes capable of governing the operation of the climate modules 40 according to a general control strategy. This is typically made by instructing the climate modules 40 about a proper operating mode, or not to be operated, and by providing a target temperature of the outgoing air.

At the same time, the local operation of the different climate modules 40 is a matter of the local climate-control unit 46. Exchange of module types or change of the number of available climate modules 40 does thereby not change the basic feed-back of measurements and decision for control procedures, except for the knowledge that the climate modules 40 are available. At the same time, each climate module 40 can be internally optimized for its intended operation and need only a small amount of operational instructions from the central climate-control unit 52, e.g. the target temperature of the outgoing air and if the module is to operate or not. The detailed control of the internal procedures of the modules is thus left to the modules themselves, which opens up for operations that are optimized for particular situations. In such a way, the adaption of the climate control system 50 to a new set of climate modules 40 can be made very quick and simple.

Another advantage of the division between a central climate-control unit 52 and local climate-control units 46 is that it provides possibilities for being less sensitive to e.g. malfunctioning communications. In a system having modules with only a central control, a malfunctioning communication with the modules will make these modules useless. However, if the modules have some local processing power, this opens up for a fallback or limp home operation mode if communication with the central control unit fails.

Each of the climate modules 40 has a temperature sensor 48 for providing feedback information for the internal operation of the climate module 40 to reach the requested target temperature. Even if communication with the central climate-control unit 52 is broken, the climate module 40 is still capable of maintaining its operation based on the latest received target temperature. At least in a first phase of such malfunctioning communication situation, the continued operation with the last available target temperature will typically be appropriate, at least for reasonably constant outer conditions, e.g. constant ambient temperatures. If the communication is restored, the normal operation principles can again be used. Details of preferred embodiments of procedures are presented further below.

For completeness, in the present invention, the climate modules 40 and the central climate-control unit 52 are powered 56 from a power system, described more further below. The central climate-control unit 52 is preferably also communicationally connected 58 to a general control unit, having the main responsibility for the entire container. The central climate-control unit 52 is preferably also communicationally connected to a connectivity unit, either directly 59 or via the general control unit.

FIG. 3 illustrates an embodiment of a climate-controlled air-freight container 10 in a cross-sectional view. The climate-controlled air-freight container 10 is defined by a casing 12. The casing 12 encloses a cargo compartment 20 and a control compartment 26. The casing 12 comprises a floor 16, a ceiling 14 and walls 18. The cargo compartment 20 and a control compartment 26 are separated by a partition wall 28.

The climate-controlled air-freight container 10 also comprises a climate system 30. The climate system 30 is configured for controlling a temperature of the cargo compartment 20 by providing a flow 100 of temperature-controlled air around and/or into the cargo compartment 20 by means of an air distribution arrangement 21. The air distribution arrangement 21 is configured to distribute air from a supply air plenum 34 of the climate system around and/or into the cargo compartment 20, and back to a return air plenum 36 of the climate system 30. The air distribution arrangement 21 is in this embodiment constituted by the inner parts of the casing and some deliberately provided flow-directing components. The flow 100 of temperature-controlled air is in this embodiment provided in vicinity of the ceiling 14 of the cargo compartment 20.

In this particular embodiment, the distribution arrangement 21 for distributing the flow 100 of temperature-controlled air is supported by an upper gas-flow distributer plate 22. The flow 100 of temperature-controlled air is here directed from supply air plenum 34 to the space between the ceiling 14 and the upper gas-flow distributer plate 22. The upper gas-flow distributer plate 22 does not cover all the distance to the walls and leaves openings for climate-conditioned gas to flow 108 into the main cargo compartment. Likewise, there is in this particular embodiment also a side gas-flow collector plate 24, placed with a small distance to the partition wall 28 separating the cargo compartment 20 from the control compartment 26. Gas leaving the cargo compartment 20 flows beneath the edge of the side gas-flow collector plate 24 and upwards along the partition wall 28 as a return air-flow 104 into the return air plenum 36.

As will be further described below, the control compartment 26 has a climate module support with at least two mounting positions. At least two climate modules 40 are mounted in the climate module support. Each climate modules 40 in operation receives air from the return air plenum 36 through an input port 42 and provides an air-flow 102 going out from the climate module 40 through an output port 44.

The climate system 30 comprises or is associated with a surveillance system comprising at least one internal temperature sensor 53A-C arranged for measuring a temperature inside the cargo compartment 20 and/or in an air-flow to 104 and/or from 102 the cargo compartment, i.e. in the supply air plenum 34 and/or the return air plenum 36.

In the present embodiment, first internal temperature sensors 53A are placed at different locations in the cargo compartment. In the present embodiment, two first internal temperature sensors 53A are placed at the side wall 18, two first internal temperature sensors 53A are placed at the side gas-flow collector plate 24 and one first internal temperature sensor 53A is placed at an edge of the upper gas-flow distributer plate 22. A second internal temperature sensor 53B is placed in the gas-flow 102 going out from the climate control system 30, i.e. in or in a vicinity of the supply air plenum 34. A third internal temperature sensor 53C is placed in the gas-flow 104 going into the climate control system 30, i.e. in or in a vicinity of the return air plenum 36. In other embodiments, other combinations of internal temperature sensors may be provided. The internal temperature sensors 53A-C are communicationally connected to a central climate-control unit 52 of the climate control system 50.

Figure 4:
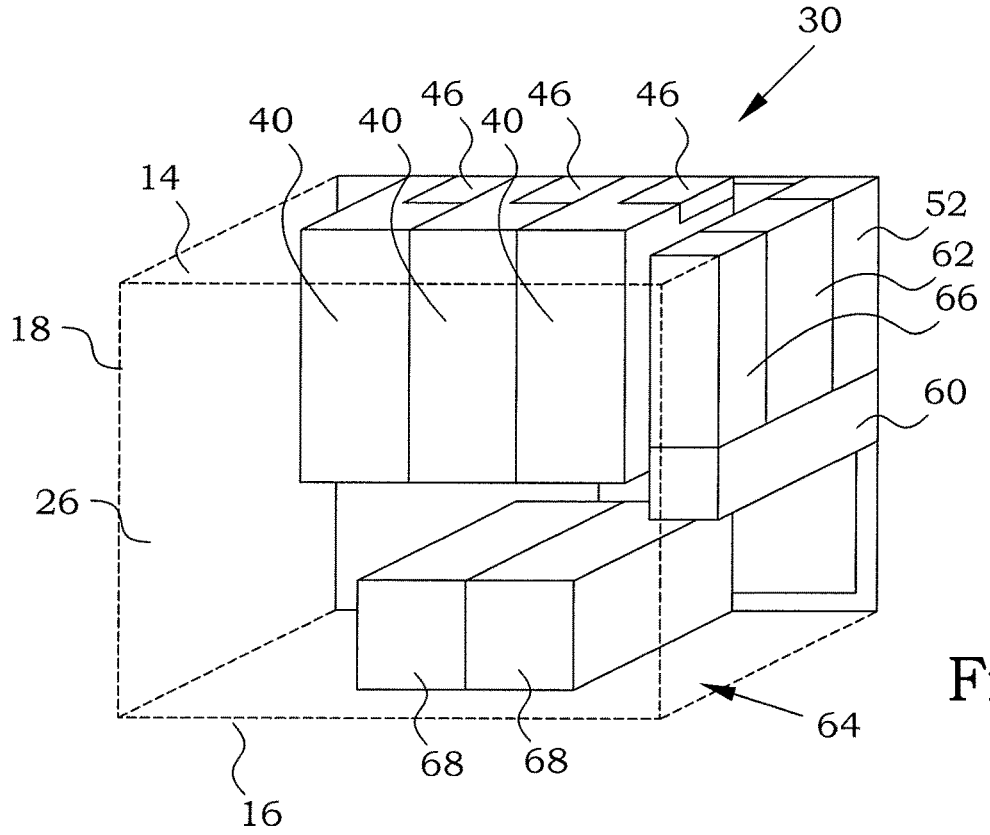
FIG. 4 is a schematic illustration of an embodiment of a control compartment of a climate-controlled air-freight container.

FIG. 4 is an illustration of an embodiment of a control compartment 26, with the walls 18, and ceiling 14 removed and only indicated by dotted lines. The climate system 30 comprises in this embodiment three climate modules 40. The climate modules 40 are mounted in the mounting positions of the climate module support in the control compartment 26. Local climate-control units 46 in the climate modules 40 are communicationally connected to a central climate-control unit 52. This communicational connection can be of any kind, wired or wireless. However, preferably it is provided via the climate module support together with e.g. the power connections and is preferably established as a part of the mechanical mounting of the climate module 40.

In other words, each of the climate modules 40 is configured for adapting climate properties of air flowing through the respective one of the climate modules 40 from the return air plenum to the supply air plenum. Each of the climate modules 40 comprises a local climate-control unit 46, configured for controlling an operation of the respective one of the climate modules 40. The local climate-control unit 46 is connected to the central climate-control unit 52. Thereby, the central climate-control unit 52 is enabled to provide operational instructions to the local climate-control units 46.

The control compartment 26 comprises in this embodiment a general control unit 60, configured for surveillance of container conditions in general. In the present embodiment, also a connectivity system 62 is provided, handling any data storage of operational data, and possible communication with any remote node for transferring of information about the container. The connectivity system 62 can also be utilized for collection of the measurements from the temperature sensors.

The climate-controlled air-freight container further comprises a power system 64, powering the climate modules 40 of the climate system 30 and the control units 46, 52, 60, 62, 66. A central power-control unit 66, for monitoring and controlling power distribution from the power system 64 is typically provided. In a preferred embodiment, also the power system 64 is based on a modular design, having a plurality of power modules 68, connected to mounting positions of a power module support.

Figure 5:
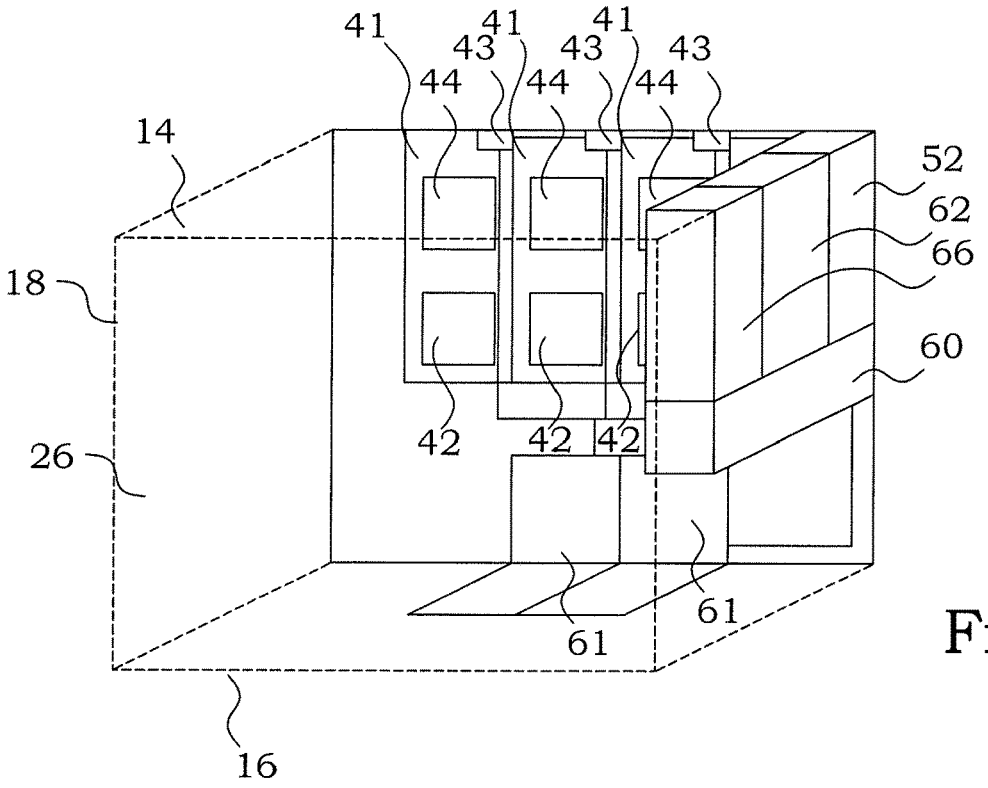
FIG. 5 is a schematic illustration of the embodiment of FIG. 4 with climate modules and power modules removed.

FIG. 5 is an illustration of the same embodiment of a control compartment 26 as in FIG. 4, but with the climate modules and power modules removed. Here, the mounting positions 41 of the climate module support are seen. Each mounting position 41 has an input port 42 and an output port 44, which fit to openings in the climate modules to be mounted. In the present embodiment, the mounting positions are also provided with a socket 43, for communication and powering connections. In the present embodiment, three mounting positions are provided. However, in other embodiments other number of mounting positions 41 may be provided, but at least two.

In the figure, a power module support presents two mounting positions 61. However, in other embodiments more than two mounting positions 61 may also be provided.

The modular design of the climate system gives many advantages. Since the control compartment has a number of prepared climate module supports, a standardized interface can be utilized. The most straight-forward advantage is that the number of climate modules can be selected depending on the intended use of the container. Furthermore, the same standardized interface can be used for e.g. different sizes of containers. In a small container, e.g. an RKN-type container, two climate module supports may be sufficient to cover most of the different climate requests. In a somewhat larger container, such as an RLP-type container, three or four climate module supports may be provided. In large containers, such as an RAP-type container, at least four climate module supports may be needed. The number of actually mounted climate modules may then be determined by the expected requirements for each shipping. For a transport that is planned to have a small exposure to very high and/or very low ambient temperatures, some of the available climate module supports may be left unused. For transports of goods requiring very accurate temperature regulation, the number of mounted climate modules may be higher, providing possibilities to high-intensity climate-control.

Typically, the minimum number of mounted climate modules is recommended to be 2. Even if only one climate module would have been sufficient, the second one can be seen as a redundant resource if the first climate module would fail.

In other words, in one embodiment, the two or more climate modules present a same set of performance characteristics. The central climate-control unit can then treat the climate modules as completely exchangeable modules. This can e.g. be utilized for redundancy purposes.

The mounted climate modules may also have different performance. The performance of a climate module may be optimized e.g. for different temperature ranges. This can be done e.g. by utilizing different cooling agents in the evaporation/condensation process. Different climate modules may also be optimized for different expected operation periods. Some design solutions may work well, but during a relatively short period of time, and may e.g. need frequent recovery periods. Other designs may instead be optimized for long-term use.

This interface, preferably encompassing both physical interface components, such as port connections ad air sealings, and electrical and communicational interfaces, such as power cables and communication lines, can advantageously be used for different types of climate modules. Based on the expected transport route, time and goods to be transported, different sets of climate modules may be selected to be the optimum choice. If all climate modules are provided with the same standardized interface, an optimized container is easily prepared for each transport occasion.

For instance, if it is known in advance that a container probably will experience a short period of very cold ambient temperatures, then be transported a long time at a medium high temperature, interrupted by one short period of very high ambient temperature, a single type of climate module being capable of providing a stable climate in the cargo compartment may be difficult to find. By the modular aspect, such a transport can be provided with three different types of climate modules; one specialized for low ambient temperatures, one specialized for high ambient temperatures and one specialized for long-term steady-state operation.

The possibilities for combinations are virtually unlimited. Climate modules optimized for cooling may be combined with climate modules optimized for heating. Climate modules optimized for long-term stable conditions may be combined with climate modules optimized for short but intense climate actions. The central climate-control unit has the information about what types of climate modules that are mounted and may depending on planned or non-planned situations select which modules to be operated at each occasion. The different climate modules can then easily be controlled by just supplying e.g. an on/off request and a target temperature. The individual climate modules are unaware of any of the other climate modules and governs its own operation independently from the other modules. This opens up for operating any combination of climate modules simultaneously. At one instant, one climate module at a time can be operated. At another instant, two or more climate modules may be operated simultaneously, and even all available climate modules may be operated simultaneously.

In other words, in one embodiment, the two or more climate modules comprises at least two climate modules having differing set of performance characteristics. The central climate-control unit can then select to order operation of climate modules that present a most appropriate performance characteristics in view of the prevailing conditions.

The flexible use of the climate modules also enables an energy efficient way to utilize e.g. the number of simultaneously used climate modules. Typically, a climate module is most energy efficient at a medium high heating or cooling load. At too low loads or at too high loads, the energy efficiency is typically less. It is thus an advantage to operate the climate modules in an intermediate range. Furthermore, energy efficiency is often improved when fewer climate modules are used. If the load increases, more than one climate module may be necessary to use. If the load decreases, it may instead, in an energy efficiency and wear view, be wise to reduce the number of simultaneously operating climate modules.

In other words, in one embodiment, the central climate-control unit is configured to select the number of actively operating climate modules based on a present load of the climate modules, so that each actively operating climate module has a load between a predetermined high load threshold and a predetermined low load threshold.

Climate modules may sometimes present problems with e.g. ice formation, excessive wear at long continuous operation, etc. It may therefore be wise to alternate the operation between different climate modules, even if the outer circumstances so request. This is of course only possible when less than all climate modules are operating simultaneously.

In other words, in one embodiment, the central climate-control unit is configured to, when less than all climate modules are operated actively, at intervals change the set of actively operating climate modules. These intervals may in further embodiments be based on e.g. an active operating time of each climate module since the last non-active period. It may also be based on e.g. accumulated operating load of each climate module since last non-active period.

As was briefly discussed further above, the module approach having different levels of climate control enables an additional security operation. If a communication between the central climate-control unit and the local climate-control units is broken, temporarily or permanently, the local climate-control units may take over the climate controlling, performing an autonomous operation. This autonomous operation then takes place without any dependence of the central climate-control unit or any of the neighboring climate modules. Also other indications of a functional error may be used to trig such an autonomous operation mode.

In other words, in one embodiment, each of the local climate-control units are further configured for autonomous operation of the respective one of the climate modules. The autonomous operation is activated if an error indication has occurred. In a further embodiment, one error indication is that communication to the local climate-control unit is interrupted.

The autonomous operation should preferably be revoked when conditions for a normal operation is regained. This means that the local climate-control units are preferably further configured for revoking the autonomous operation when communication to the local climate-control unit is re-established.

There are also other types of error situations in which an autonomous operation can be of use. If the normal control function of the central climate-control unit fails, the autonomous operation may also be of use. The failure could be a failure within the central climate-control unit itself, giving unreasonable orders to the climate modules. The failure could also be caused by errors in the collected measurement data, caused by erroneous temperature sensors or failing communication between the temperature sensors and the central climate-control unit. The failure could also be e.g. a mechanical failure of the container casing, causing a climate-emergency situation. In such cases, a temperature sensor in each climate module, arranged for measuring a temperature in or in the vicinity of the return air plenum may assist. If this temperature rises or falls outside a certain failure temperature range, the existence of an error can be concluded. This failure temperature range has of course to be considerably wider than the normal operation fluctuations of the return air plenum temperatures. In such cases, the individual local climate-control units may take over the responsibility and on their own behalf trying to restore the climate within the cargo compartment.

In other words, in one embodiment, each climate module comprises a temperature sensor, configured for measuring a temperature in the return air plenum. The error indication is then that a temperature in the return air plenum is outside a predetermined error-indication temperature interval.

The autonomous operation may be limited in time. In one embodiment, the local climate-control units are further configured for revoking the autonomous operation a predetermined time after the temperature in the return air plenum has returned within the predetermined error-indication temperature interval.

If each climate module comprises a temperature sensor, configured for measuring a temperature in the return air plenum, the autonomous operation is in one embodiment based on a reading of the temperature sensor. A severe deviation from the error-indication temperature interval may call for a longer period of autonomous operation, whereas a moderate deviation from the error-indication temperature interval may call for a somewhat shorter autonomous operation period.

The actions taken by the local climate-control units may be configured in many different ways. One possibility is to use the temperature sensor reading as an indication of what might be necessary.

In one embodiment, if the reading of the temperature sensor indicates a temperature above a predetermined autonomous-operation temperature interval, the autonomous operation comprises cooling of air flowing through the associated climate module. A far too high temperature in the return air indicates that an additional cooling action may be required.

In one embodiment, if the reading of the temperature sensor indicates a temperature below a predetermined autonomous-operation temperature interval, the autonomous operation comprises heating of air flowing through the associated climate module. A far too low temperature in the return air indicates that an additional heating action may be required.

In one embodiment, if the reading of the temperature sensor indicates a temperature within a predetermined autonomous-operation temperature interval, the autonomous operation comprises temperature-influence-free ventilation of air flowing through the associated climate module. In other words, when the temperature deviation is not very remarkable, it may be enough with e.g. just increasing the speed of the fans without actually increasing the cooling or heating. The predetermined autonomous-operation temperature interval is preferably comprised within the predetermined error-indication temperature interval.

During autonomous-operation periods, each climate module is configured to operate with a predetermined autonomous-operation target temperature within the predetermined autonomous-operation temperature interval. This predetermined autonomous-operation temperature interval and target temperature can be set manually, e.g. in connection with the installation in the climate module support, or it can be set by the central climate control unit, e.g. during a preconditioning phase for the climate-controlled air-freight container.

In some situations, in particular where many climate modules are used in a climate-controlled air-freight container, autonomous operation may lead to instabilities. The total capacity of the available climate modules is often much higher than the average steady-state operation, since the design often is targeted on the capabilities for the extreme situations. If the connection to between the central climate control unit and all of the climate modules is broken, all climate units will enter into autonomous operation.

A possible scenario may then be that all climate modules initially will start to cool the outgoing air at a very high level. Since there is a certain lag in the temperature response of a cargo compartment, the return air to the climate modules will not change until some time later. During this lag, the climate modules together could have produced so much cooling that the temperature within the cargo compartment will risk falling below the admitted temperature range. When the return air finally indicates this, falling below the lower limit of the predetermined autonomous-operation temperature interval, the climate modules may all instead switch over to heating. The result could thus be that all climate modules will enter into a temperature oscillation situation, alternating cooling and heating periods. This is obviously very energy inefficient.

To mitigate such risks, the predetermined autonomous-operation target temperature and/or predetermined autonomous-operation temperature interval can be set slightly different in the different climate modules. As a non-limiting example, if three climate modules are present in a climate-controlled air-freight container, a first one can be given a predetermined autonomous-operation target temperature of 4.8° C., a second one can be given a predetermined autonomous-operation target temperature of 5.0° C. and the third one can be given a predetermined autonomous-operation target temperature of 5.2° C., with corresponding interval limits. In such a case, when the temperature in the return air starts to decrease, the third climate module will react first and reduce its cooling effect, while the two others still are active. After a while, also the second one may reduce its cooling effect and further later maybe also the first one. When the temperature in the return air again turn towards higher temperatures, the first climate module reacts first and starts cooling, and only later, the second and third climate modules turn on their cooling actions. In such a way, any oscillating behaviour is damped.

In other words, one embodiment of the climate-control method comprises the step of setting different such predetermined autonomous-operation temperature intervals in different climate modules.

In an apparatus aspect, the climate modules are configured with different predetermined autonomous-operation temperature intervals.

A typical climate module is based on the common action of an evaporator, a condenser and a compressor. Heat is assimilated in a cooling agent in an evaporator and is again emitted after passing the condenser. This is the conventional heat pump operation. By letting the evaporator come in thermal contact with the air of the return air plenum, a cooling effect is achieved. By instead letting the condenser and compressor come in thermal contact with the air of the return air plenum, a heating effect is achieved. In other words, the same unit can be used as a cooling equipment or a heating equipment just depending on the direction it is mounted in the control compartment.

Furthermore, by thermally insulating the climate module in such a way that there is low thermal conductivity between a first side comprising the evaporator and a second side comprising the compressor and condenser, the operational heat created by the compressor can be separated from the cooled air if the climate module is used for cooling. However, if the climate module is used for heating, the operational heat created by the compressor will contribute to the heating.

Figure 6:
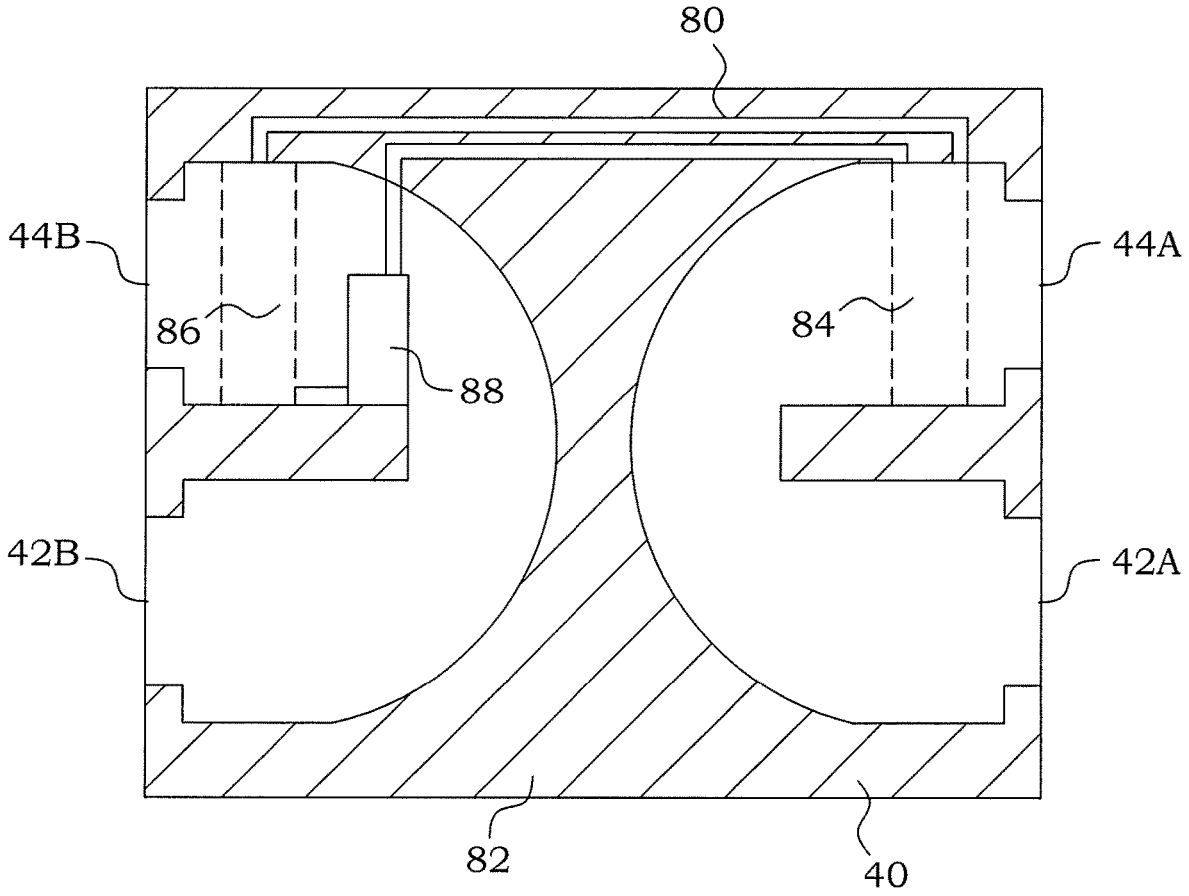
FIG. 6 is a schematic illustration of an embodiment of a two-way-connectable climate module.

In FIG. 6, a cross-section view of an embodiment of a two-way connectable climate module 40 is illustrated. The two ends of the climate module 40 do both fit into the same climate module support. In this way, the climate module 40 can be mounted in either direction in the control compartment. A cooling side of the climate module 40 presents an input port 42A and an output port 44A. Likewise, a heating side of the climate module 40 presents an input port 42B and an output port 44B. Both these pairs of ports fit into the same mounting position of the climate module support, so that the climate module 40 can be fitted in either direction.

A cooling arrangement 80 is schematically illustrated, having an evaporator 84, a condenser 86 and a compressor 88 connected in a fluid loop with a cooling agent. The operation of the cooling arrangement 80 is well-known by any person skilled in the art and will not be discussed in further detail. However, during operation, the evaporator 84 becomes cold, and by providing the evaporator in contact with an air stream from the container by connecting the cooling side of the climate module to the mounting position, the air can be cooled. The condenser 86 will during the operation of the cooling arrangement 80 be hot, and this heat can be transferred to air circulating in and out of int input port 42B and the output port 44B. This air will also assimilate heat from the operation of the compressor 88. In this way, heat can be removed from the climate module in to the control compartment and further away from the container.

If instead the heating side is connected to the mounting positions, air from the container will enter through the input port 42B, be heated by the condenser 86 and also from the extra heat from the operation of the compressor 88, and will exit through output port 44B into the cargo compartment of the container. A heating action is then achieved, which utilizes not only the condenser 86 heat, but also the operation heat of the compressor 88. The two sides of the climate module 40 are thermally isolated by an isolation 82. The circulation of air within the climate module 40 is typically established by fans (not shown), providing a throughput of air through both sides of the module.

Therefore, in one embodiment, the climate modules are designed to fit into the mounting positions in two different directions, one cooling operation direction and one heating operation direction. Each of the climate modules comprises a compressor, an evaporator, a condenser and a thermally insulating wall between on one hand the evaporator and on the other hand the condenser and the compressor. The evaporator is provided in contact with the air flowing from the return air plenum to the supply air plenum when the climate module when is mounted in the cooling operation direction. The condenser and the compressor are provided in contact with the air flowing from the return air plenum to the supply air plenum when the climate module is mounted in the heating operation direction.

Returning to FIG. 4 and FIG. 5, it can be seen that in this embodiment, the module concept has also been applied to the power system. To this end, the control compartment 26 has a power module support 70 with in this embodiment two mounting positions and that the power system 64 has in this embodiment two power modules 68 mounted in the power module support 70. The number of power module supports 70 is preferably adapted to the size of the container so that the maximum available power will be sufficient for most applications. The number of power module supports 70 is preferably at least two, which provides a possibility have redundancy modules. The actual number of mounted power modules 68 is then selected according to the demands of each particular transport, i.e. dependent on climate requests for the cargo, transport time, expected ambient temperatures etc. Each of the power modules 68 comprises electric battery means for storing of electrical charge. A central power-control unit 60 is then configured to control the use of the at least two power modules 68.

Figure 7:
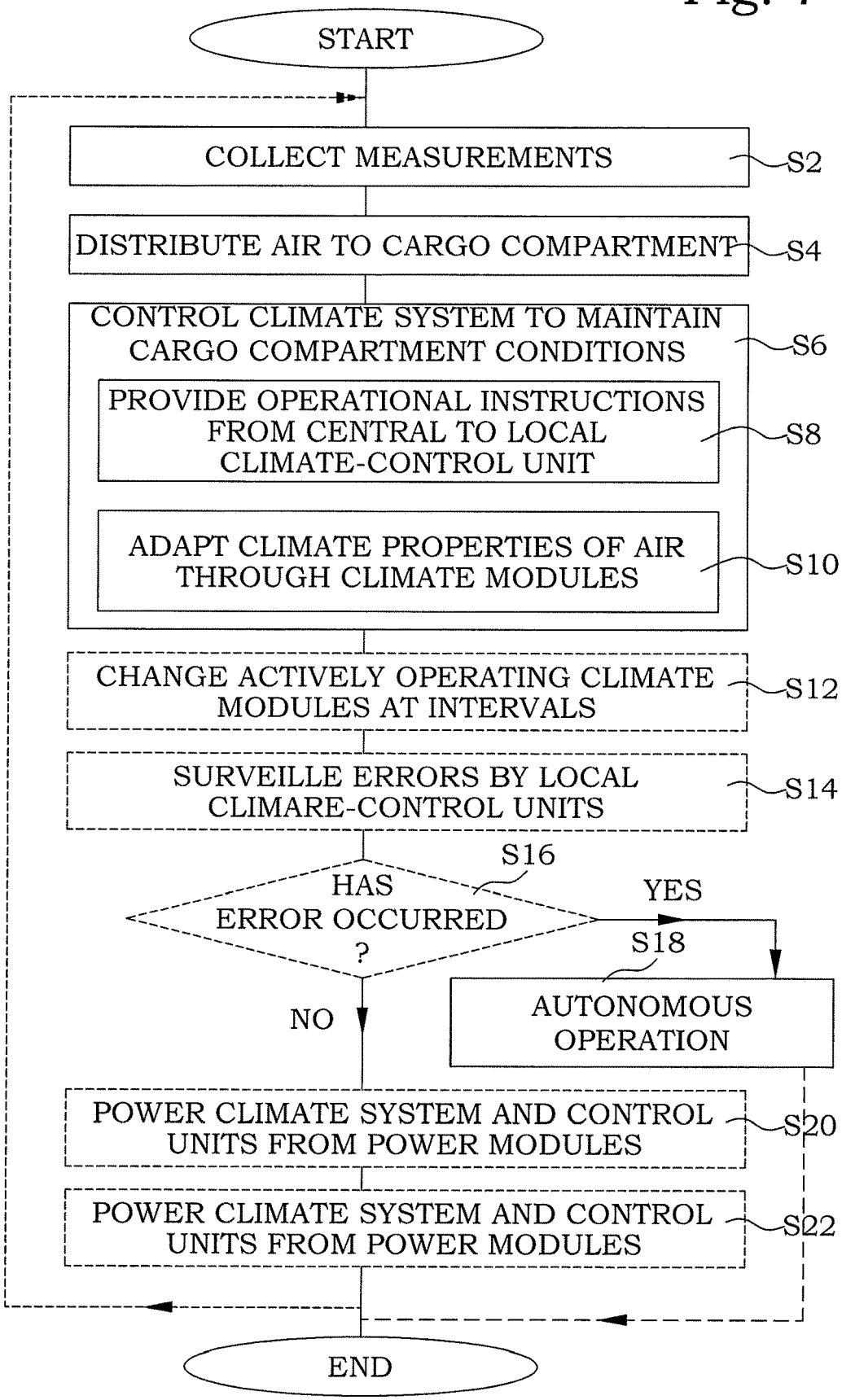
FIG. 7 is a flow diagram of steps of an embodiment of a climate-control method for an air-freight container.

The present ideas can also be viewed from the procedural point of view. FIG. 7 illustrates a flow diagram of steps of an embodiment of a climate-control method for an air-freight container. In step S2, measurements associated with climate conditions of a cargo compartment of the air-freight container are collected. In step S4, air is distributed from a supply air plenum of a climate system around and/or into the cargo compartment, and back to a return air plenum of the climate system. In step S6, the climate system is controlled to maintain predetermined climate conditions in the cargo compartment. This step comprises further part steps. In step S8, operational instructions are provided from a central climate-control unit of the climate system to local climate-control units of climate modules of the climate system. The climate system has at least two climate modules. The controlling S6 of the climate system further comprises the step S10, in which climate properties of air flowing through the respective one of the at least two climate modules from the return air plenum to the supply air plenum are adapted. Thereby, locally controlling of an operation of the respective one of the at least two climate modules is performed in each of the at least two climate modules based on the operational instructions to the local climate-control units.

In one preferred embodiment, the step S6 of controlling of the climate system further comprises selecting the number of actively operating climate modules based on a present load of the climate modules, so that each actively operating climate module has a load between a predetermined high load threshold and a predetermined low load threshold.

In one preferred embodiment, the climate-control method comprises the further step S12, in which the set of actively operating climate modules is changed at intervals. This is of course only possible to perform when less than all climate modules are operated actively. In a further embodiment, these intervals are based on the active operating time of each climate module since last non-active period. Alternatively, or as a complement, the intervals may also be based on the accumulated operating load of each climate module since last non-active period.

In one embodiment, where the at least two climate modules present a same set of performance characteristics, the step S8, where operational instructions are provided from a central climate-control unit of the climate system to local climate-control units of the at least two climate modules, is based on that the at least two climate modules can be treated as completely exchangeable modules.

In another embodiment, where the at least two climate modules comprises at least two climate modules having differing set of performance characteristics, the step S8 of providing operational instructions from a central climate-control unit of the climate system to local climate-control units of the at least two climate modules is performed by a selection of climate modules to operate that is based on a determination of which climate modules present a most appropriate performance characteristics in view of the prevailing conditions.

In one embodiment, he climate-control method comprises the further step S14, in which error surveilling is performed by each of the local climate-control units. If this step has indicated that an error has occurred, as determined in step S16, the process continues to step S18. In step S18, each one of the at least two climate modules is autonomously operated.

In one further embodiment, the error surveilling of step S14 comprises surveilling of communication to the local climate-control unit. An error is then indicated to have occurred if the communication to the local climate-control unit is interrupted. Preferably, the autonomous operation is revoked when communication to the local climate-control unit is re-established.

In another further embodiment, the error surveilling of step S14 comprises measuring of a temperature in the return air plenum. An error indication is considered to be present if a temperature in the return air plenum is outside a predetermined error-indication temperature interval. Preferably, the autonomous operation is revoked a predetermined time after the temperature in the return air plenum has returned within the predetermined error-indication temperature interval.

In one embodiment, where a temperature in the return air plenum is measured, the step S18 of autonomously operating the climate module is based on that temperature measure. Preferably, the step S18 of autonomously operating of the climate module comprises cooling of air flowing through the associated climate module when the temperature measure indicates a temperature above a predetermined autonomous-operation temperature interval. Preferably, the step S18 of autonomously operating of the climate module comprises heating of air flowing through the associated climate module when the temperature measure indicates a temperature below a predetermined autonomous-operation temperature interval. Preferably, the step S18 of autonomously operating of the climate module comprises temperature-influence-free ventilation of air flowing through the associated climate module when the temperature measure indicates a temperature within a predetermined autonomous-operation temperature interval. The predetermined autonomous-operation temperature interval is preferably comprised within the predetermined error-indication temperature interval.

In one embodiment, the climate-control method comprises the further step S20, in which the climate system and the control units are powered from a power system. The power system has at least two power modules comprising electric battery means for storing of electrical charge. In step S22, the powering from the at least two power modules is monitored and controlled from a central power-control unit.

The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined in other configurations, where technically possible. The scope of the present invention is, however, defined by the appended claims.

The invention claimed is:

1. A climate-controlled freight container, comprising:

a casing, enclosing a cargo compartment and a control compartment, said control compartment having a climate module support with at least two mounting positions;

a climate system;

said climate system has at least two climate modules mounted in said climate module support and an air distribution arrangement, configured to distribute air from a supply air plenum of said climate system at least one of around or into said cargo compartment, and back to a return air plenum of said climate system; and a central climate-control unit, for collection of measurements associated with climate conditions of said cargo compartment and for controlling said climate system to maintain predetermined climate conditions in said cargo compartment; and wherein each of said at least two climate modules is configured for adapting climate properties of air flowing through the respective one of said at least two climate modules from said return air plenum to said supply air plenum;

wherein each of said at least two climate modules comprises a local climate-control unit, configured for controlling an operation of the respective one of said at least two climate modules;

said local climate-control unit being communicationally connected to said central climate-control unit, whereby said central climate-control unit is configured for providing operational instructions to said local climate-control units.

2. The climate-controlled freight container according to claim 1, wherein each of said local climate-control units are further configured for autonomous operation of the respective one of said at least two climate modules, whereby said autonomous operation is activated if an error indication has occurred.

3. The climate-controlled freight container according to claim 2, wherein one said error indication is that communication to said local climate-control unit is interrupted.

4. The climate-controlled freight container according to claim 2, wherein each climate module comprises a temperature sensor, configured for measuring a temperature in said return air plenum, and wherein one said error indication is that a temperature in said return air plenum is outside a predetermined error-indication temperature interval.

5. The climate-controlled freight container according to claim 2, wherein each climate module comprises a temperature sensor, configured for measuring a temperature in said return air plenum, and wherein said autonomous operation is based on a reading of said temperature sensor.

6. The climate-controlled freight container according to claim 1, wherein said central climate-control unit is configured to, when less than all climate modules are operated actively, at intervals change the set of actively operating climate modules.

7. The climate-controlled freight container according to claim 1, wherein said at least two climate modules present a same set of performance characteristics, whereby said central climate-control unit can treat said at least two climate modules as completely exchangeable modules.

8. The climate-controlled freight container according to claim 1, wherein said at least two climate modules comprises at least two climate modules having differing set of performance characteristics, whereby said central climate-control unit can select to order operation of climate modules that present a most appropriate performance characteristics in view of the prevailing conditions.

9. The climate-controlled freight container according to claim 1, wherein said climate modules designed to fit into said mounting positions in two different directions, one cooling operation direction and one heating operation direction.

10. The climate-controlled freight container according to claim 9, wherein each of said climate modules comprises a compressor, an evaporator, a condenser and a thermally insulating wall between on one hand said evaporator and on the other hand said condenser and said compressor, whereby said evaporator is provided in contact with said air flowing from said return air plenum to said supply air plenum when said climate module being mounted in said cooling operation direction and whereby said condenser and said compressor are provided in contact with said air flowing from said return air plenum to said supply air plenum when said climate module being mounted in said heating operation direction.

11. The climate-controlled freight container according to claim 1, wherein said control compartment has a power module support with at least two mounting positions and a power system, whereby said power system has at least two power modules mounted in said power module support, said power modules comprise electric battery means for storing of electrical charge, whereby said power system has a central power-control unit, whereby said central power-control unit is configured to control the use of said at least two power modules.

12. A climate-control method for a freight container, comprising the steps of:

collecting measurements associated with climate conditions of a cargo compartment of said freight container;

distributing air from a supply air plenum of a climate system at least one of around or into said cargo compartment, and back to a return air plenum of said climate system; and controlling said climate system to maintain predetermined climate conditions in said cargo compartment;

said climate system has at least two climate modules;

wherein said step of controlling said climate system in turn comprises the step of:

providing operational instructions from a central climate-control unit of said climate system to local climate-control units of said at least two climate modules;

whereby said step of controlling said climate system comprises adapting of climate properties of air flowing through the respective one of said at least two climate modules from said return air plenum to said supply air plenum;

whereby locally controlling of an operation of the respective one of said at least two climate modules is performed in each of said at least two climate modules based on said operational instructions.

13. The climate-control method according to claim 12, comprising the further step of:

error surveilling in each of said local climate-control units;

autonomously operating each one of said at least two climate modules if said step of error surveilling indicates that an error has occurred.

14. The climate-control method according to claim 13, wherein said error surveilling comprises surveilling of communication to said local climate-control unit, whereby an error is indicated to have occurred if said communication to said local climate-control unit is interrupted.

15. The climate-control method according to claim 13, wherein said error surveilling comprises measuring a temperature in said return air plenum, whereby an error indication is considered to be present if a temperature in said return air plenum is outside a predetermined error-indication temperature interval.

16. The climate-control method according to claim 13, comprising the further step of:

measuring a temperature in said return air plenum;

whereby said step of autonomously operating the climate module is based on said temperature measure.

17. The climate-control method according to claim 12, wherein said step of controlling of said climate system comprises:

selecting the number of actively operating climate modules based on a present load of said climate modules, so that each actively operating climate module has a load between a predetermined high load threshold and a predetermined low load threshold.

18. The climate-control method according to claim 12, comprising the further step of:

changing the set of actively operating climate modules at intervals, when less than all climate modules are operated actively.

19. The climate-control method according to claim 18, wherein said intervals are based on at least one of:

active operating time of each climate module since last non-active period; and accumulated operating load of each climate module since last non-active period.

20. The climate-control method according to claim 12, comprising the further steps of:

powering said climate system and said control units from a power system;

said power system has at least two power modules comprising electric battery means for storing of electrical charge;

monitoring and controlling said powering from said at least two power modules from a central power-control unit.

* * * * *